US006409095B2

(12) United States Patent
King

(10) Patent No.: US 6,409,095 B2
(45) **Date of Patent: *Jun. 25, 2002**

(54) GLASS BULB ATTACHMENT FOR DECORATIVE SPRINKLER

(75) Inventor: Courtney A. King, Ypsilanti, MI (US)

(73) Assignee: Bird Brain, Inc., Ypsilanti, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/812,612

(22) Filed: Mar. 20, 2001

Related U.S. Application Data

(63) Continuation of application No. 09/625,155, filed on Jul. 25, 2000, now Pat. No. 6,202,937.

(51) Int. Cl.[7] ..... B05B 17/08
(52) U.S. Cl. ..... 239/17; 239/211; 239/251
(58) Field of Search ..... 239/16–18, 211, 239/225.1, 246, 251, 261, 264, 265, 280; 285/148.23, 148.19, 404, 906, 915, 911; D23/201

(56) References Cited

U.S. PATENT DOCUMENTS

| | | | | | |
|---|---|---|---|---|---|
| 1,766,514 | A | * | 6/1930 | Henry | 239/280 |
| 1,780,332 | A | * | 11/1930 | Brickhill | 239/280 |
| 1,790,732 | A | * | 2/1931 | Tichava | 239/280 |
| 1,791,222 | A | * | 2/1931 | Orr | 239/280 |
| 6,015,098 | A | * | 1/2000 | Krueger | 239/261 |
| 6,109,546 | A | * | 8/2000 | Ormiston | 239/245 |
| 6,202,937 | B1 | * | 3/2001 | King | 239/17 |

* cited by examiner

*Primary Examiner*—Lisa A. Douglas
(74) *Attorney, Agent, or Firm*—Young & Basile, P.C.

(57) ABSTRACT

An adapter for connecting a glass ornament to the metal blind bore upright found in standpipe-type sprinkler heads. The adapter is configured to be permanently secured over a base portion of the glass ornament, and further has a lower oversleeve portion adapted to be removably secured over an upper end of the blind bore upright.

7 Claims, 3 Drawing Sheets

FIG-2
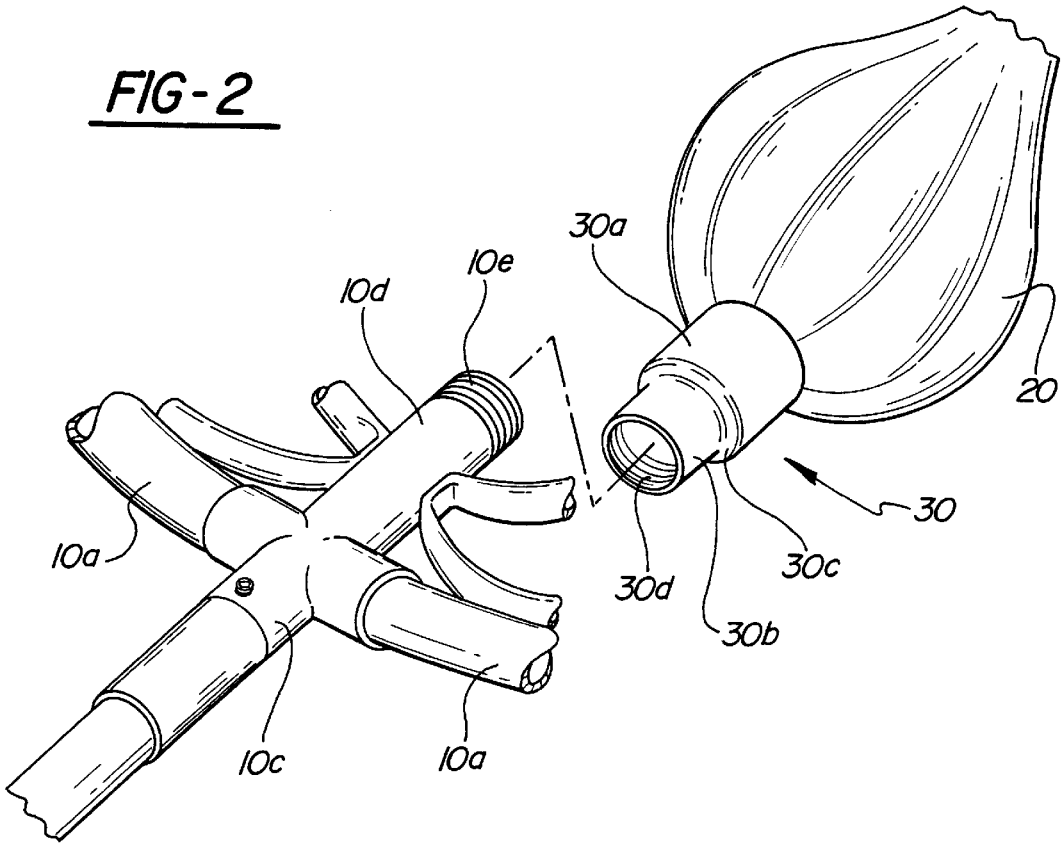
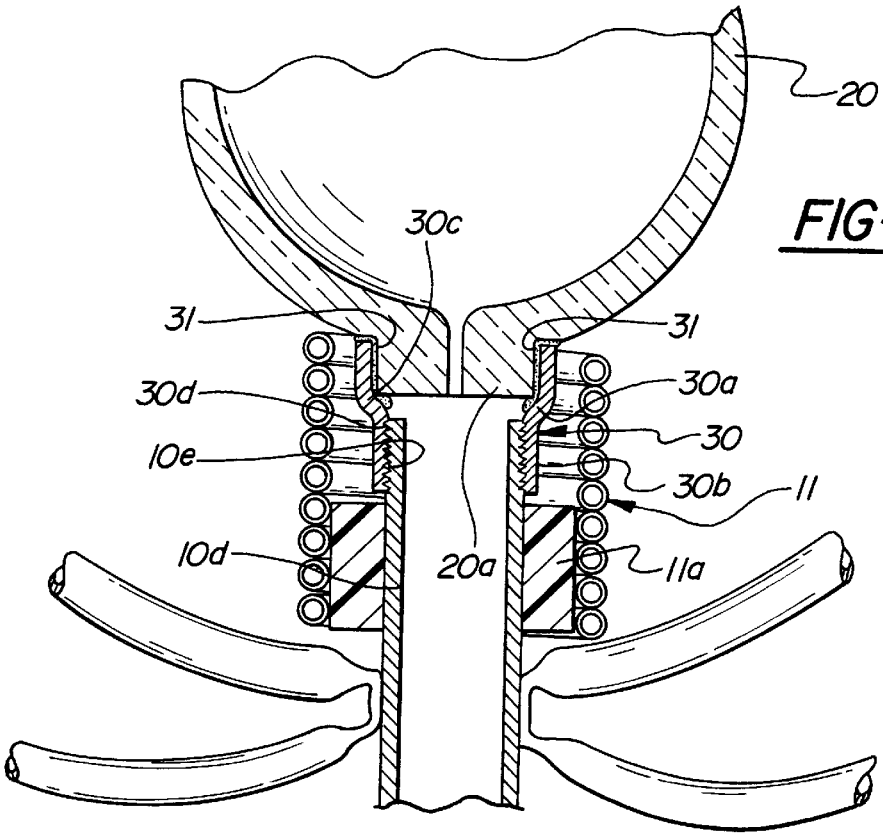
FIG-3

FIG-4
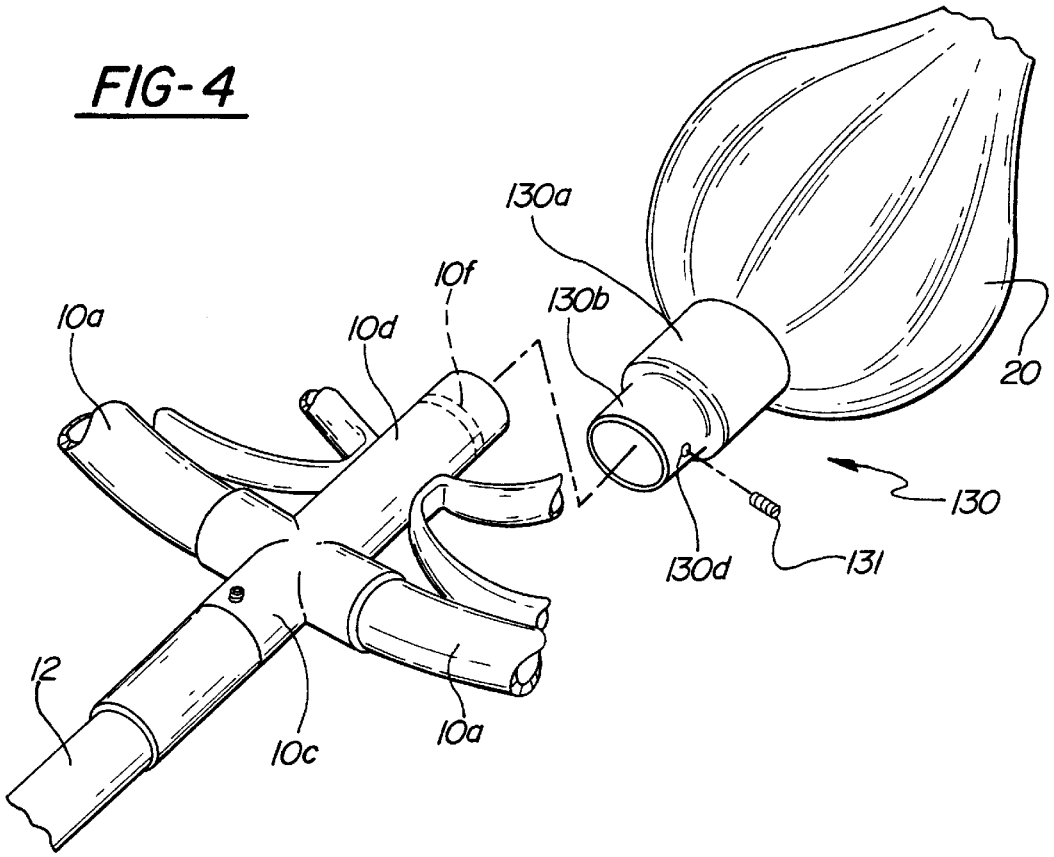
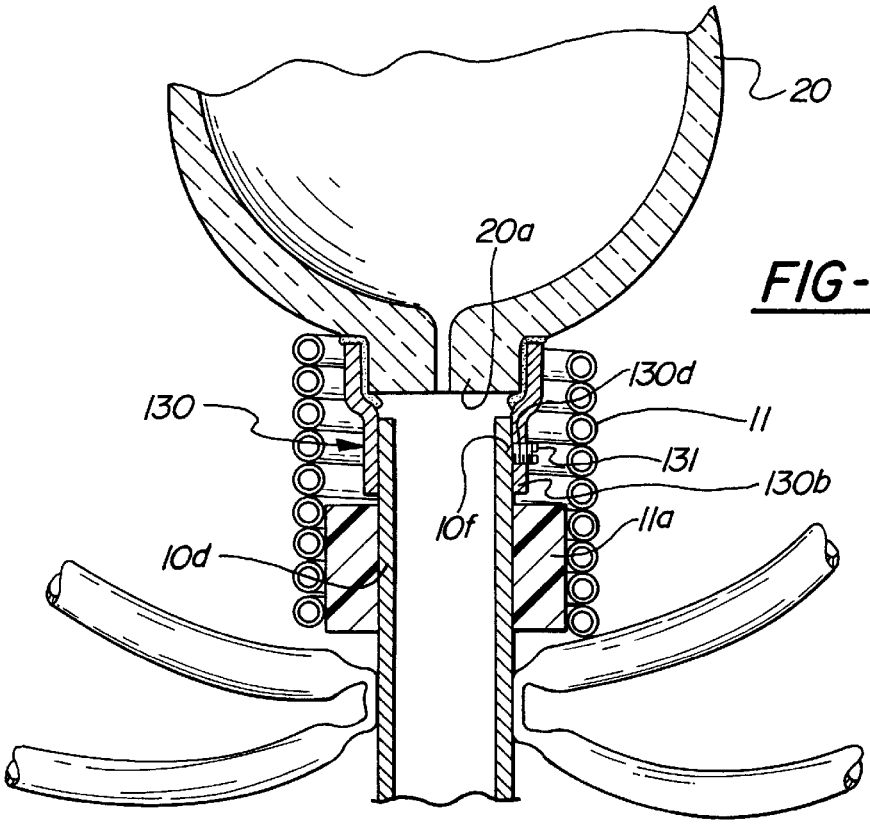
FIG-5

GLASS BULB ATTACHMENT FOR DECORATIVE SPRINKLER

This application is a continuation of U.S. patent application Ser. No. 09/625,155, filed Jul. 25, 2000, and now issued as U.S. Pat. No. 6,202,937.

FIELD OF THE INVENTION

The present invention is in the field of attachment structures for glass ornaments and bulbs, in particular for the "gazing ball" or "finial" types used on upright supports such as rotating sprinklers.

BACKGROUND OF THE INVENTION

Tall, upright, sculpture-like sprinklers have been around for many years and are becoming very popular. These sprinklers typically comprise a tube-fashioned, artistically-shaped sprinkler head rotatably mounted on the top of a vertical standpipe of several feet in length, which in turn is secured to the ground and supplied with water from a hose. Water from the stand pipe flows into appropriate tubing on the sprinkler head and exits from a pattern of spray holes which causes the sprinkler head to rotate on top of the standpipe.

A common style of sprinkler head uses a circular outer water tube perforated with the spray holes in a pattern designed to throw an aesthetically pleasing and rotation-causing spray of water. The area circumscribed by the water tubing is often filled with decorative ornamentation, for example, a blown glass gazing ball or bulb of brightly colored glass.

A difficulty lies in connecting the glass piece to the sprinkler head.

SUMMARY OF THE INVENTION

The invention is an adapter for attaching a glass ornament such as a bulb or gazing ball to a blind socket in a standpipe type rotating sprinkler head. The adapter comprises a socket with an upper end adapted to receive a glass plug at the base of the ornament in an adhesive connection, and a lower portion (preferably necked down), adapted to be mechanically and removably secured to the blind socket on the sprinkler head by extending over the blind socket in the manner of an oversleeve. The upper end of the blind socket may be modified to receive the oversleeve portion of the adapter.

These and other features and advantages of the invention will become apparent upon further reading of the specification in light of the accompanying drawings.

BRIEF DESCRIPTION OF THE DRAWINGS

FIG. 2 is a perspective, disassembled view of a glass ornament equipped with the inventive adapter and its manner of attachment to a blind socket on the sprinkler head.

FIG. 3 is a side elevational view, in section, of the components in FIG. 2, assembled and provided with a decorative cover.

FIG. 4 is a perspective view of a slightly modified version of the inventive adapter on a glass ornament, similar to the view in FIG. 3.

FIG. 5 is a side elevational view, in section, of the modified adapter assembly of FIG. 4.

DETAILED DESCRIPTION OF THE ILLUSTRATED EMBODIMENTS

Figure 1:
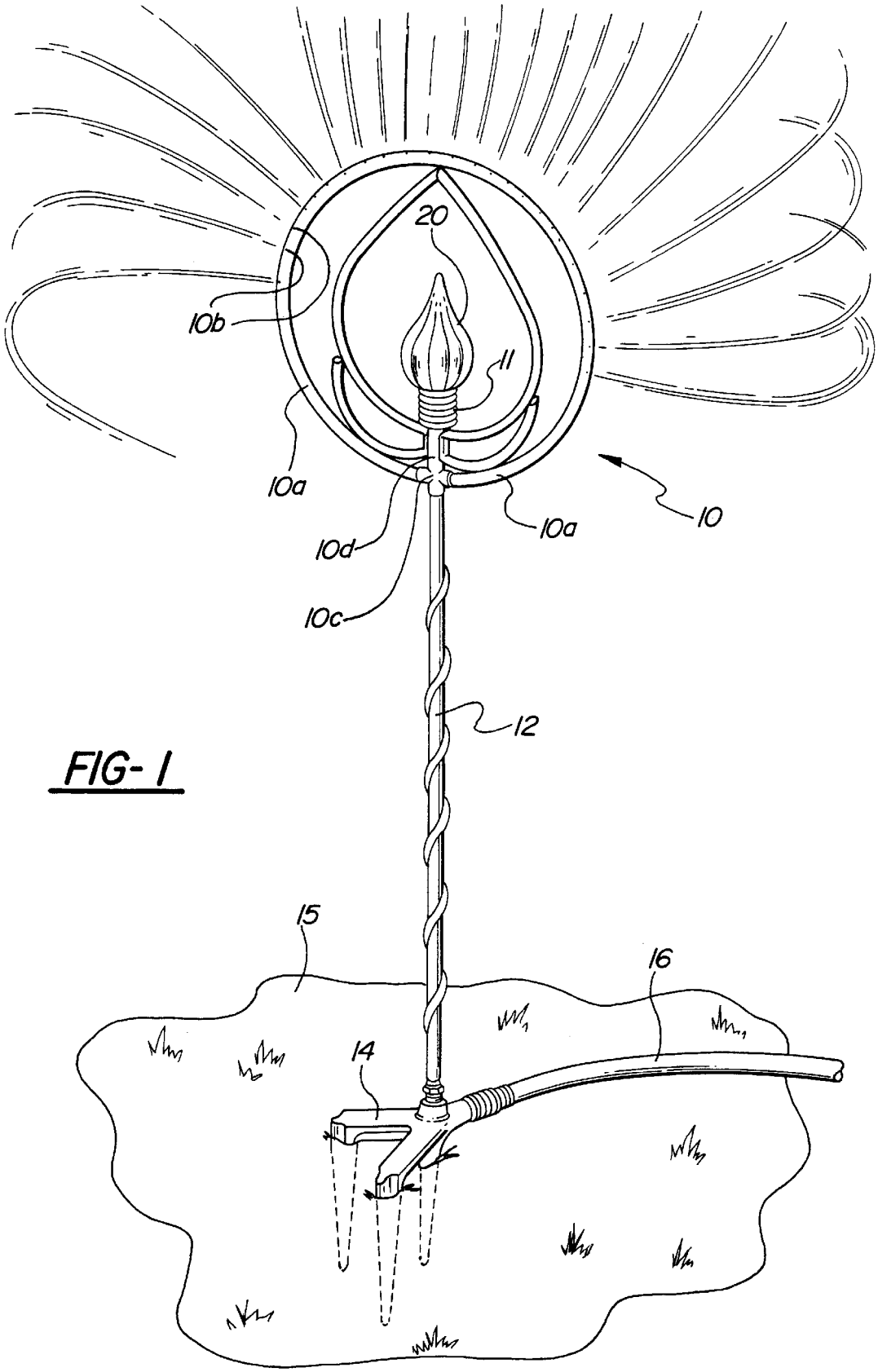
FIG. 1 is a perspective view of a standpipe-type sprinkler incorporating the present invention to mount a glass ornament inside a rotating sprinkler head.

Referring first to FIG. 1, a decorative upright lawn sprinkler of generally known type is shown comprising a sprinkler head 10 rotatably mounted on a water-transporting standpipe 12 secured to a base 14 and anchored in lawn 15. Water is supplied to the standpipe by garden hose 16 attached to a water passage in base 14. The details of base 14 are disclosed in a copending patent application assigned to the assignee of the present application. Likewise, the rotatable connection between sprinkler head 10 and standpipe 12 is the subject of another copending patent application assigned to the assignee of the present application.

Sprinkler head 10 comprises water conducting tubing 10*a* formed in a circle and connected at its ends to a T-fitting 10*c* to receive pressurized water from standpipe 12. Holes 10*b* formed on the upper half of water tubing 10*a* emit the pressurized water in a desired spray pattern which causes sprinkler head 10 to rotate on standpipe 12.

The upper end of T-fitting 10*c* forms an upright member for supporting an ornament. In the illustrated embodiment the upright member is a tubular, blind bore socket 10*d* opening upwardly to receive the base of a hollow glass bulb ornament 20. The connection between blind bore socket 10*d* and the base of bulb 20 is the subject of the present invention. The connection between the base of bulb 20 and socket 10*d* is hidden by an ornamental collar 11, in the illustrated embodiment a spiral of decorative copper tubing.

Referring next to FIGS. 2 and 3, an inventive adapter 30 is permanently secured to a lower end of bulb 20 and is mechanically and removably secured over the upper end of the blind bore socket 10*d* on the sprinkler head T-fitting 10*c*. In the embodiment illustrated in FIGS. 2 and 3, adapter 30 is formed from metal such as copper or brass, although other materials such as different metals or plastics could be used. Adapter 30 has an upper end 30*a* having a larger diameter and a lower end 30*b* having a smaller diameter. Upper end 30*a* has an internal diameter sized to snugly receive a cylindrical base 20*a* of glass bulb 20, and as shown in FIG. 3 is permanently secured thereto with an adhesive shown at 31. The depth of upper end 30*a* is preferably sized such that the bottom-most portion of glass bulb base 20*a* abuts the shoulder 30*c* between upper end 30*a* and lower end 30*b*.

While the illustrated embodiment shows an upper end 30*a* having a cylindrical diameter adapted to be secured to a cylindrical glass bulb base 20*a*, it will be apparent to those skilled in the art that non-cylindrical mating connections are within the scope of the invention, and will depend on the shape of the glass bulb base.

Lower end 30*b* of the inventive adapter is designed to be mechanically and removably secured over the upper end of blind bore 10*d* on the sprinkler head. In the embodiment illustrated in FIGS. 2 and 3, the interior of lower portion 30*b* of the adapter is provided with threads 30*d* adapted to threadingly mate with threads 10*e* formed on the exterior of the upper end of blind bore 10*d*.

The removability of the connection between bulb 20 and the sprinkler head is important should the bulb need to be replaced or removed, whether for aesthetic or repair reasons.

Referring in particular to FIG. 3, decorative collar 11 includes an internal collar portion 11*a*, for example formed from plastic inserted in a friction fit inside the copper tubing of collar 11, with a bore adapted to fit over the outside of tubular socket 10*d*. The upper end of collar 11 has a larger inside diameter to fit over the glass bulb base 20*a* and adapter 30, and to admit a set screw tightening tool if a set screw attachment is used.

Referring to FIGS. 4 and 5, a slightly modified version of socket 30 is illustrated at reference number 130, essentially identical to adapter 30 in FIG. 2 but with alternate structure for removably securing the adapter over socket 10*d*. Internal threads 30*d* have been replaced with a set screw aperture 130*d* and a set screw 131 adapted to frictionally lock lower end 130*b* to the upper outside surface of blind bore 10*d* on the sprinkler head. To improve the locking connection between the set screw 131 and upper end 10*d*, the blind bore may be provided with an external circumferential groove 10*f* adapted to receive set screw 131.

The foregoing embodiments of the invention are set forth for illustrative purposes, and are not intended to limit the invention beyond the scope of the claims below. Those skilled in the art will understand that various minor modifications can be made to the invention as illustratively described herein without departing from the scope of the invention.

Accordingly, I claim:

1. In a standpipe type sprinkler having a sprinkler head which includes an upright member adapted to mount an ornament, an adapter arrangement for mounting a glass ornament to the upright member, comprising:

a glass ornament having a protruding base portion;

an adapter socket having an upper end sized to receive the base portion of the glass ornament, the upper end being permanently fastened to the base portion of the glass ornament, and a lower end adapted to fit over the upright member on the sprinkler head, the lower end further including means for removably securing the adapter to an outer surface of the upright member.

2. The apparatus of claim 1, wherein the upright member on the sprinkler head has a threaded outside surface at its upper end, and the lower end of the adapter includes internal threads adapted to be mated with the threads on the upright member.

3. The apparatus of claim 1, wherein the lower end of the adapter includes a set screw adapted to be tightened against an outside surface of the upright member.

4. The apparatus of claim 1, wherein the upper end of the adapter is permanently secured to the base portion of the glass ornament with adhesive.

5. The apparatus of claim 1, further including a decorative cover member adapted to fit over the upright member, the cover member having an internal upright-engaging portion adapted to slide over the upright member in a close conforming fit to a position below an upper end of the upright member, the decorative cover further having an upper end of the diameter or width sufficient to admit the base portion of the glass ornament with the adapter attached thereto for securing the adapter to the upper end of the upright member while the decorative cover is positioned on the upright member.

6. The apparatus of claim 5, wherein the upper end of the upright member and the lower end of the adapter includes mating threads for a threaded connection.

7. The apparatus of claim 5, wherein the lower end of the adapter includes a set screw adapted to be tightened against an outside surface of the upper end of the upper member, and the diameter or width of the upper end of the decorative cover is sufficient to admit a set screw tightening tool.

* * * * *